US005168889A

United States Patent [19]

Diestel

[11] Patent Number: 5,168,889

[45] Date of Patent: Dec. 8, 1992

[54] WHEELCHAIR WEATHER BREAKER COVER

[76] Inventor: Daniel G. Diestel, 1265 E. 5th Ave., Chico, Calif. 95926

[21] Appl. No.: 433,149

[22] Filed: Nov. 8, 1989

[51] Int. Cl.[5] ..... E04H 15/06

[52] U.S. Cl. ..... 135/88; 297/184; 135/106

[58] Field of Search ..... 135/90, 96, 88, 106; 297/184, 191, 391, 397, 440, DIG. 2, DIG. 4

[56] References Cited

U.S. PATENT DOCUMENTS

| | | | |
|---|---|---|---|
| 496,252 | 4/1893 | Eva | 135/90 X |
| 539,041 | 5/1895 | Doolittle | 135/90 X |
| 739,446 | 9/1903 | Reger | 135/90 X |
| 1,271,515 | 7/1918 | Murray . | |
| 2,641,770 | 6/1953 | Chapin | 135/101 X |
| 2,810,390 | 10/1957 | Wallace et al. | 135/DIG. 9 X |
| 3,448,748 | 6/1969 | Walrave | 135/106 X |
| 4,201,416 | 5/1980 | Vanderminden . | |
| 4,285,355 | 8/1981 | Lundblade | 135/106 X |
| 4,389,057 | 6/1983 | Richards, Jr. . | |
| 4,533,170 | 8/1985 | Banks et al. . | |
| 4,643,479 | 2/1987 | Servi . | |
| 4,754,987 | 7/1988 | Williams . | |
| 4,924,896 | 5/1990 | Carter | 135/96 X |

FOREIGN PATENT DOCUMENTS

| | | |
|---|---|---|
| 3522674A | 2/1987 | Fed. Rep. of Germany . |
| 2120089A | 11/1983 | United Kingdom . |

*Primary Examiner*—David A. Scherbel
*Assistant Examiner*—Lan Mai

[57] ABSTRACT

The invention provides a simple removable and storable weather and sun covering for a wheelchair. Two embodiments include a soft cover version which can be dismantled and stowed in a container on the wheelchair and a hard top version which can be easily removed and stored when not needed. Common to both covers is a cover support clamp bracket uniquely suited for securing a variety of covers and cover frames to the frame of most any wheelchair. The cover support clamp bracket can be left on the wheelchair even when not in use or easily removed when not needed. A tubular extension fitting the clamping bracket increases wheelchair cover stability. No special frame work retainers are required in the framework of the soft cover such as corner joints or collars as seen in other cover frameworks.

1 Claim, 6 Drawing Sheets

WHEELCHAIR WEATHER BREAKER COVER

BACKGROUND OF THE INVENTION

1. Field of the Invention

This invention relates to protective weather coverings for wheelchairs with the present invention being particularly directed at collapsible and removable coverings.

2. Description of the Prior Art

To view past art protective covers useful for wheelchairs and similar vehicles, a search conducted in the classes and subclasses 135/88, 96, 117 and 297/124, 184 produced the following U.S. and foreign patents:

1. An early patent issued to Murray dated Jul. 2, 1918, U.S. Pat. No. 1,271,515, illustrates a mobile bed and chair structure which includes a cover frame for the head of the bed or chair whichever the device is being used for.

2. The Vanderminden device, U.S. Pat. No. 4,201,416, dated May 6, 1980, shows a canopy construction for outdoor furniture arranged for shading a reclining seat.

3. A patent issued to Thomas, United Kingdon, GB 2,120,089 A, published Nov. 30, 1983, shows a curved windowed canopy in which a seat may be suspended.

4. A somewhat complicated wheelchair cover is shown in U.S. Pat. No. 4,389,057, issued to Richard, jr. on Jun. 21, 1983.

5. In the U.S. Pat. No. 4,533,170, dated Aug. 6, 1985, a stroller cover and support frame is illustrated.

6. A PVC pipe frame for supporting a wheelchair sun shade is shown in U.S. Pat. No. 4,643,479. The patent was issued to Servi on Feb. 17, 1987.

7. A German patent, DE 3522674 A1, dated Feb. 19, 1987, illustrates a full covering with extending front and rear lap area platforms for a wheelchair.

8. In the Williams patent, U.S. Pat. No. 4,754,987, dated Jul. 5, 1988, a full wheelchair structure including a weather closure is shown.

The foregoing patents appear to illustrate a progression of developing art in the form of sun shade and protective weather coverings for strollers, mobile chairs, and wheelchairs. None of these patents seem to provide a simple on-off covering for temporary use to shade or protect a wheelchair patient from sun or weather. Most of the past art patents show either overly complicated frameworks or complete enclosures rather than simple sun shades and removable rain or weather protective tops. A simple easily removable device for attaching different cover frames to any wheelchair frame was not seen.

SUMMARY OF THE INVENTION

Therefore, in practicing my invention, I have overcome deficiencies revealed in past art patents by providing a simple removable and storable weather and sun covering for a wheelchair. The invention also includes an easily removable cover support clamp bracket uniquely suited for securing a variety of covers and cover frames to the frame of most any wheelchair. The cover support clamp bracket can be left on the wheel chair even when not in use or easily removed when not needed. A tubular extension fitting the clamping bracket increases wheelchair cover stability. The covering is provided in a first embodiment having a takedown frame which can be easily assembled and disassembled, stored in a container, and the container carried right along attached at the side of the wheelchair with the cover available for immediate use when needed. The cover frame is interfitting and retained by a fabric cover being snapped onto the assembled frame with snap fasteners. No special frame work retainers are required such as corner joints or collars as seen in other cover frameworks. In a second embodiment, I provide a one-pieced hard top removable cover which can be easily attached to a wheelchair when needed and easily removed for storage. The cover support clamp bracket is common to both embodiments of the invention. Both covers have a rear view window and the hard top cover also has side windows.

BRIEF DESCRIPTION OF THE PREFERRED EMBODIMENTS

Figure 1:
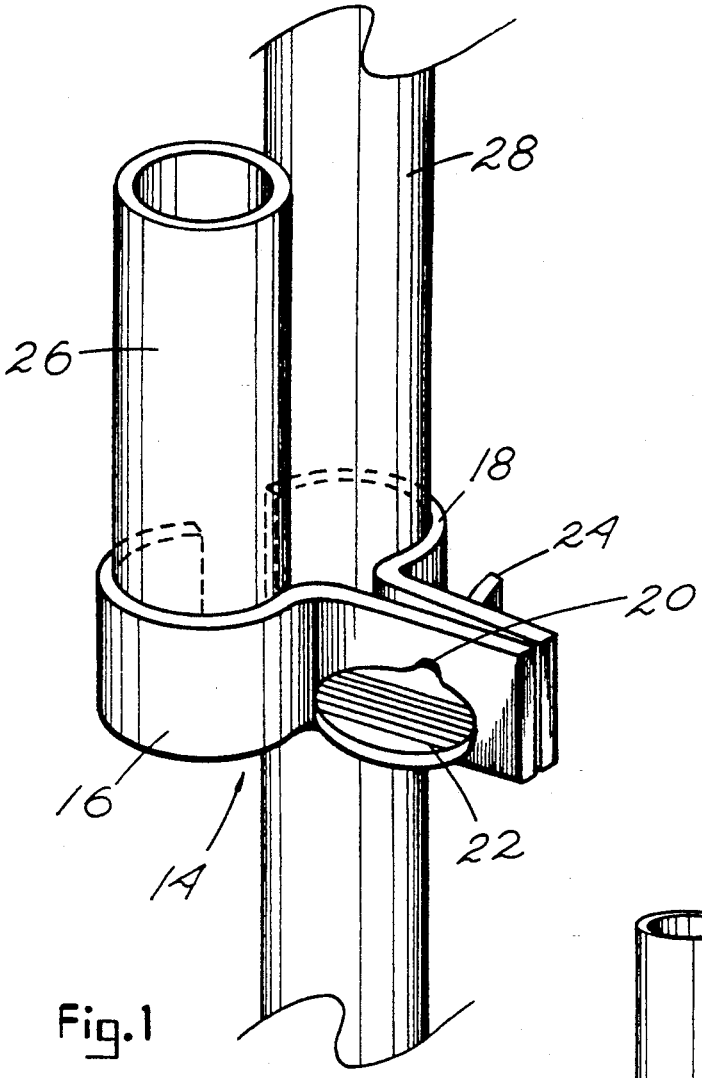
FIG. 1 shows the double sided cover support clamp bracket in an assembled view attached to a vertical tubular member of a wheelchair frame. The extended cover frame stability tube is shown retained in the cover support clamp bracket left in the illustration.
Figure 2:
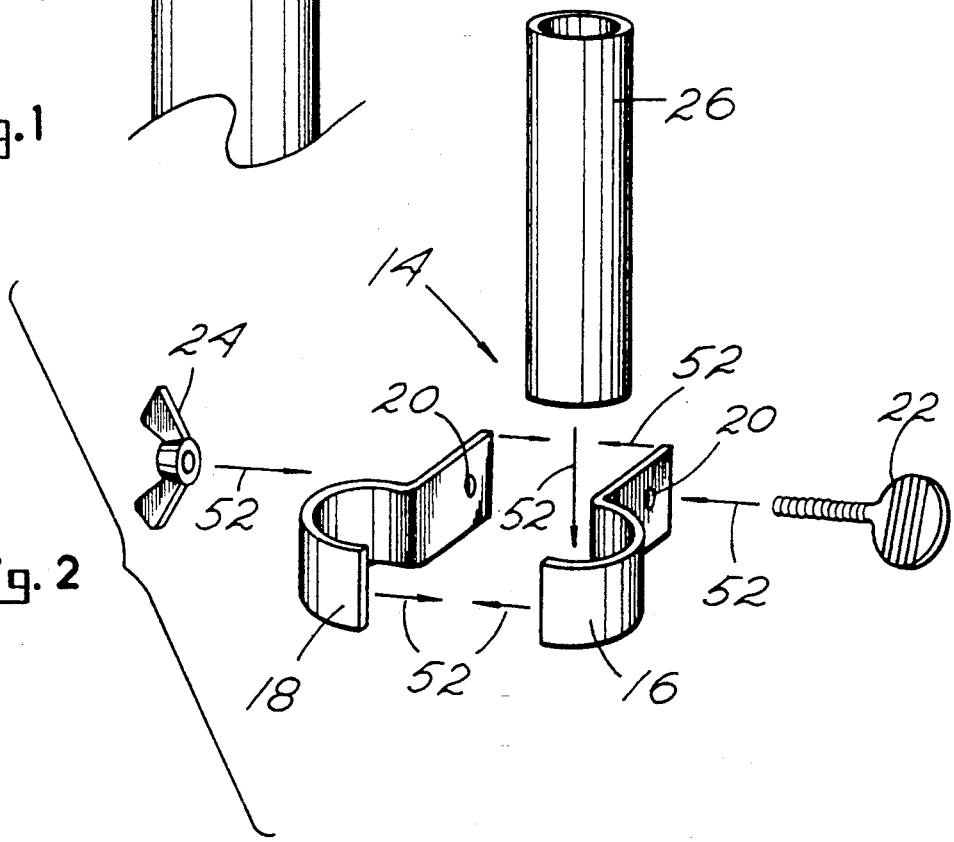
FIG. 2 illustrates disassembled parts of the cover support clamp bracket and the cover frame stability tube. The wing nut and thumb screw combination shown provides a tighten device operational by hand without needing a tool.

Referring now to the drawings where preferred embodiments of the invention are illustrated in detail. In describing two principal embodiments, a soft cover embodiment is generally referred to as soft cover 10 and a one-piece hard cover embodiment is generally referred to as hard top 12. For supporting both soft cover 10 and hard top 12, a special clamping device, cover support clamp bracket 14, useful on most any wheelchair is shown assembled in FIG. 1 and detailed in FIG. 2. In FIG. 1, double sided cover support clamp bracket 14 is shown assembled and attached to wheelchair vertical post member 28. Cover frame stability tube 26 is clamped against wheelchair vertical post member 28 by partial encirclement of first bracket clamp member 16 which is secured by second bracket clamp member 18 partially encircling wheelchair vertical post member 28 with the threaded end of thumb screw 22 passed through bracket clamp apertures 20 attached with wing nut 24 holding the two bracket member securely together. This attaches and positions cover frame stability tube 26 vertically aligned with wheelchair vertical post member 28. Cover frame stability tube 26 is a tubular section arranged vertically and of sufficient length to provide stability to an attached framework described further in this specification. FIG. 2 further details the parts of cover support clamp bracket 14 disassembled and illustrates cover frame stability tube 26 detached. In FIG. 2, the separated parts include first bracket clamp member 16, right in the illustration, and second bracket clamp member 18, left in the illustration, each having opposing half circle curved ends and opposing flat ends with aligned bracket clamp apertures 20 in the flat ends. Right in the illustration, is thumb screw 22 ready to be passed through bracket clamp apertures 20 in both flat ends of bracket clamp members 16 and 18. On the opposite side, left in the illustration, is wing nut 24 ready to be attached to the threads of thumb screw 22 and clamp the two sections together with the lower end of cover frame stability tube 26 between the curved ends. By using thumb screw 22 and wing nut 24, cover support clamp bracket can be mounted and dismounted on wheelchair vertical post member 28 by hand without the use of tools. It is to be noted that movement indicator arrows 52 are used as assemblage directional indicators in the various illustrations.

Figure 3:
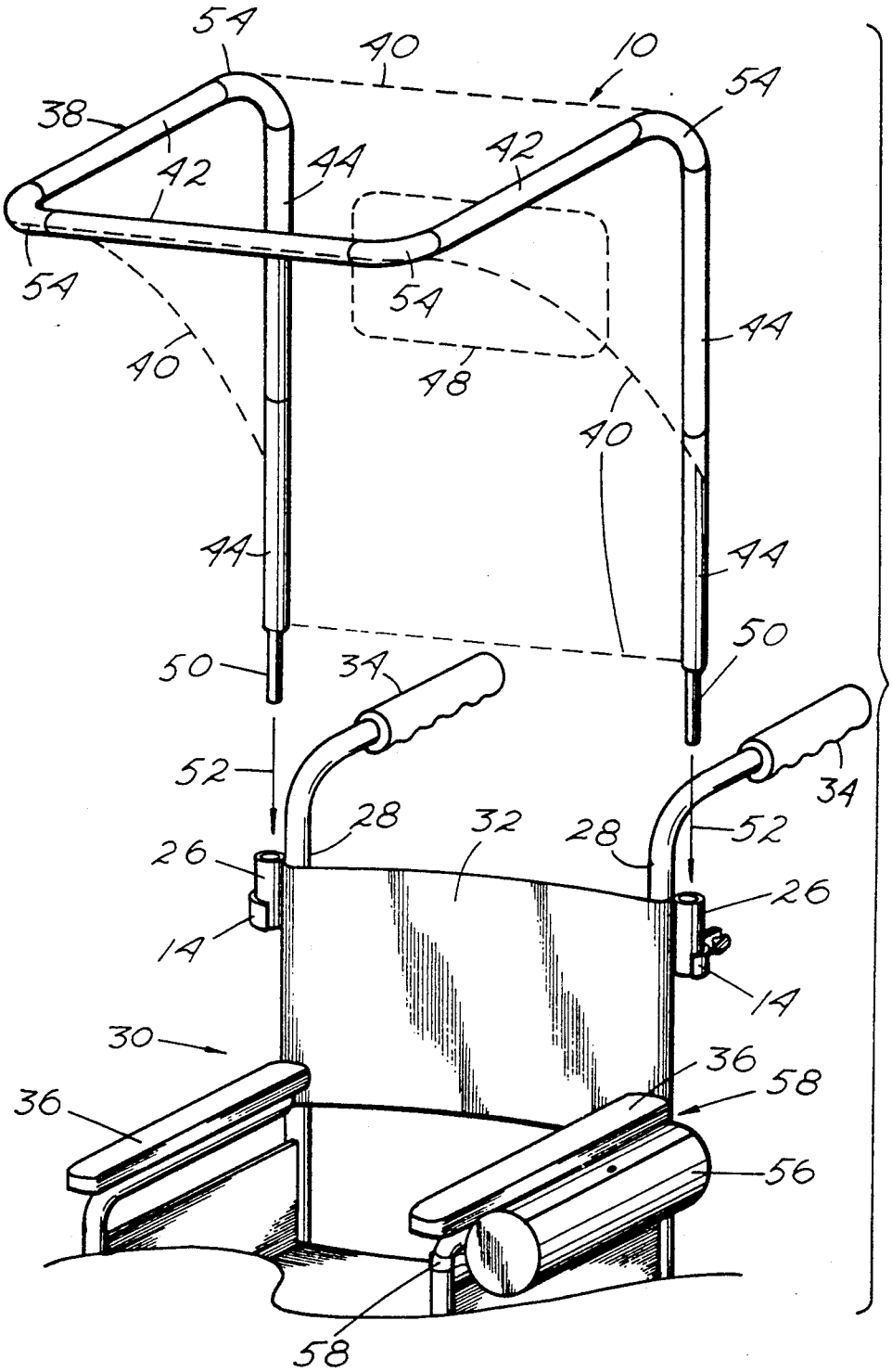
FIG. 3 is a perspective view of the assembled cover support clamp bracket and the cover frame stability tube attached to the wheelchair back frame members with the insert ends of the assembled cover framework positioned to fit down into the cover frame stability tube. The fabric cover is indicated in this drawing by dotted lines and a carrying case for the disassembled cover is shown attached to the side of the wheelchair.
Figure 4:
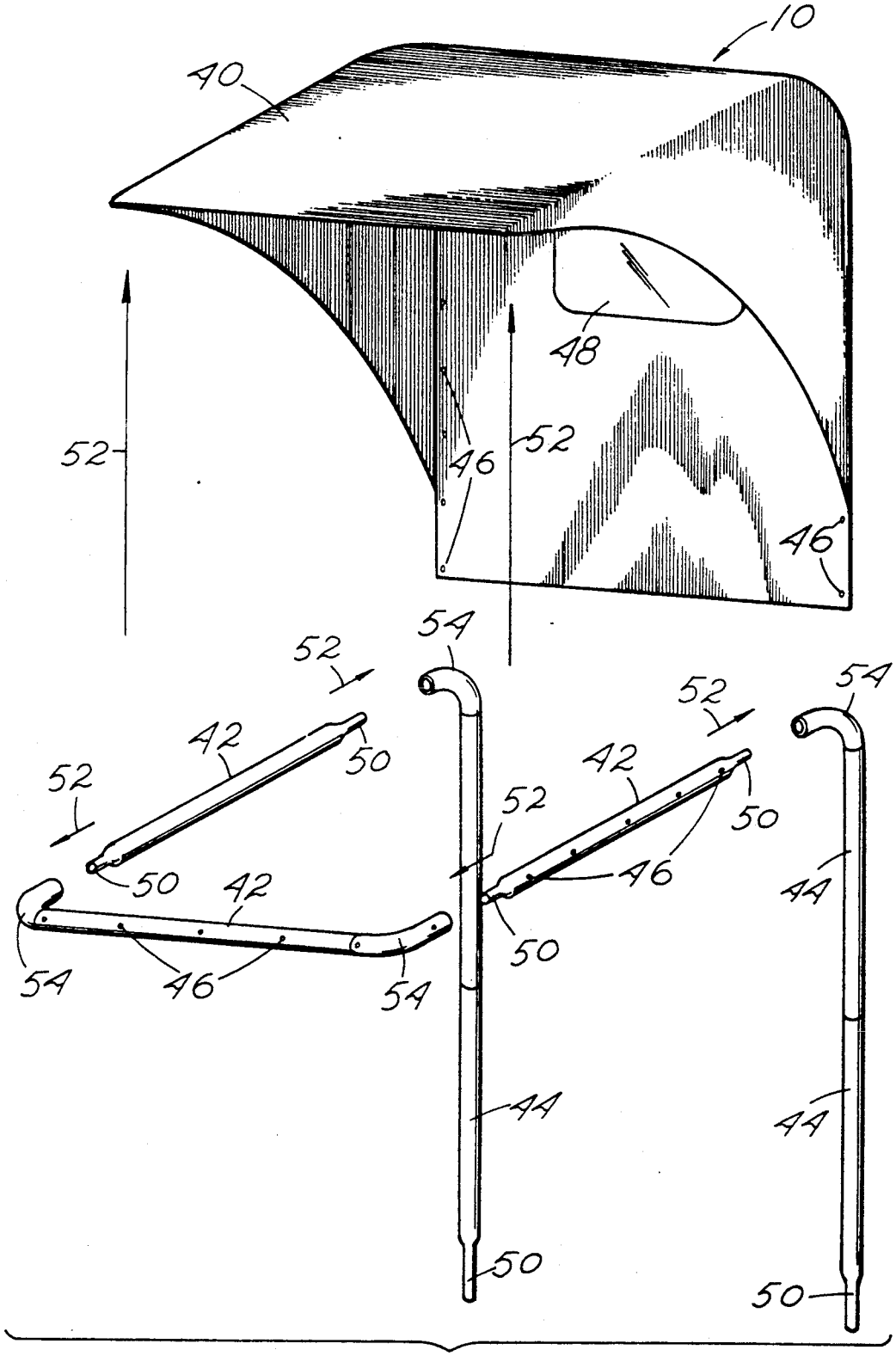
FIG. 4 is a perspective view of the disassembled cover framework with the sections positioned for assembly and the fabric cover above the framework ready to be fastened to the framework members by snap fasteners shown along the top of the framework and up the inside back of the fabric cover. A rear viewing window is shown.
Figure 5:
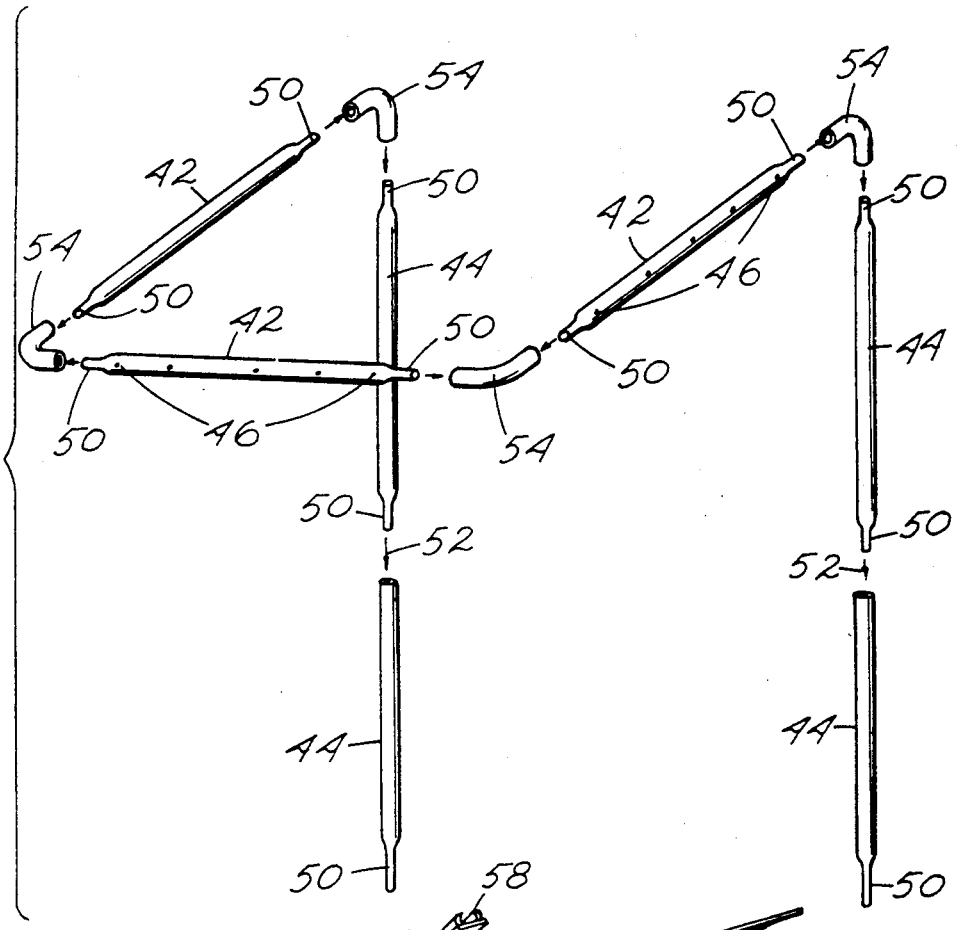
FIG. 5 is a perspective view of the fully disassembled framework aligned for attachment illustrating the short sizes of the tubular sections and the narrowed insert ends which fit into the wider ends of the framing tubes. Cover snap-on fittings can be seen aligned along the horizontal front tube member and the horizontal side tube member.

Referring to FIG. 3, the previously described cover support clamp bracket 14 is shown attached to wheelchair vertical post members 28 on wheelchair 30 on either sides of wheelchair backrest 32 just below wheelchair handles 34. Cover frame assemblage 38 is a takedown framework and is shown all together and positioned above wheelchair 30 ready for installation. Fabric covering 40 is indicated by dotted lines in FIG. 3 and fully illustrated in FIG. 4. In FIG. 3, horizontal frame sections 42 are shown attached to each other at the front by corner frame sections 54 and at the rear to vertical frame sections 44 also by corner frame sections 54. Vertical frame sections 44 are positioned for installation with narrowed insert frame ends 50 aligned for insertion into cover frame stability tubes 26. The length of cover frame stability tubes 26 is sufficient to maintain the assembled cover frame assemblage 38 with fabric covering 40 installed quite firmly making the soft cover 10 embodiment according to the invention adequate for sun shading and for protection during less severe weather conditions. Soft cover 10 has a rear window so the occupant can see behind wheelchair 30 or an attendant can look in on a patient. The window in soft cover 10 is designated rear view and surveillance window 48. For installation, cover frame assemblage 38 is attached together by inserting the illustrated narrow insertion frame ends 50 into the opened ends of the other sections, see FIG. 3, and the lower narrow insertion frame ends 50 are inserted into cover frame stability tubes 26. Fabric cover 40, see FIG. 4, is attached to the assembled frame by cover attachment snaps 46 and soft cover 10 is installed and ready for use. FIG. 5 is illustrative of the full extent of disengagement which can be accomplished with the frame of the soft cover 10 embodiment of the present invention. FIG. 4 primarily illustrates how fabric covering 40 fits over the assembled cover frame assemblage 38, partly assembled in the illustration, and how fabric covering 40 retains the frame securely together through attachment of fabric covering 40 to assembled cover frame 38 by cover attachment snaps 46. No special fittings are required to maintain the sections together of cover frame assemblage 38 when fabric covering 40 is affixed by cover attachment snaps 46. Cover attachment snaps 46 are aligned as shown in FIG. 4 and FIG. 5 along the outside edges of horizontal frame sections 42 and along the backs of vertical frame sections 44. Although cover attachment snaps 46 are not visible on vertical frame sections 44 in the perspective drawings, they are aligned along the back sides of both vertical frame sections 44. Matching cover attachment snaps 46 can be seen inside along the back of fabric covering 40 being illustrative of the unseen alignment of cover attachment snaps 46 edging the side inside edges and front of fabric covering 40.

Figure 6:
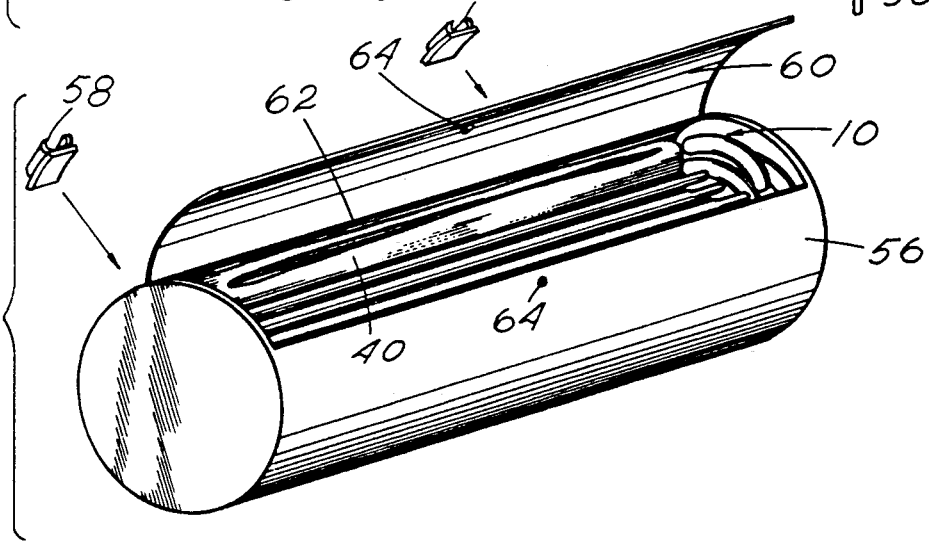
FIG. 6 is a perspective view of the carrying case enlarged with the top opened and the disassembled cover framework and the folded fabric cover stowed inside.

The FIG. 5 drawing shows how completely the takedown frame of soft cover 10 can be disassembled for storage in carrier case 56 shown enlarged in FIG. 6 and attached to wheelchair 30 in FIG. 3. In FIG. 5, horizontal frame sections 42 are separated from corner frame sections 54 and from vertical frame sections 44 by pulling narrowed insert frame ends 50 out of their respective attachment openings in the other frame sections. Fabric covering 40 can be folded and stowed along with the disassembled sections of cover frame assemblage 38 in carrier 56 as shown in FIG. 6.

In FIG. 6, carrier case 56, as can be seen enlarged, is a tubular case with flat ends. Carrier case lid 60 is openable along the line formed by carrier case lid hinge 62, a living or a commercial hinge, preferably of the piano hinge type, allowing access for storage inside carrier case 56. The disassembled cover frame assemblage 38 and the folded fabric covering 40 can easily be stowed inside of carrier case 56. Carrier case 56 can be fastened to the frame of wheelchair armrests 36 just under the rests by hook-on carrier case attachment brackets 58, illustrated detached, on the back side of carrier case 56 in FIG. 5. Carrier case attachment brackets 58 are fastened to the back side of carrier case 56 by glue, by rivet, or by any suitable attachment method in a manner to hold carrier case 56 positioned at the side of wheelchair 30, preferably hooked to the arms of wheelchair armrests 36 and to wheelchair vertical post members 28 as shown in FIG. 3. Carrier case lid 60 can be closed and secured by any suitable attachment such as carrier case closure snap 64.

Figure 7:
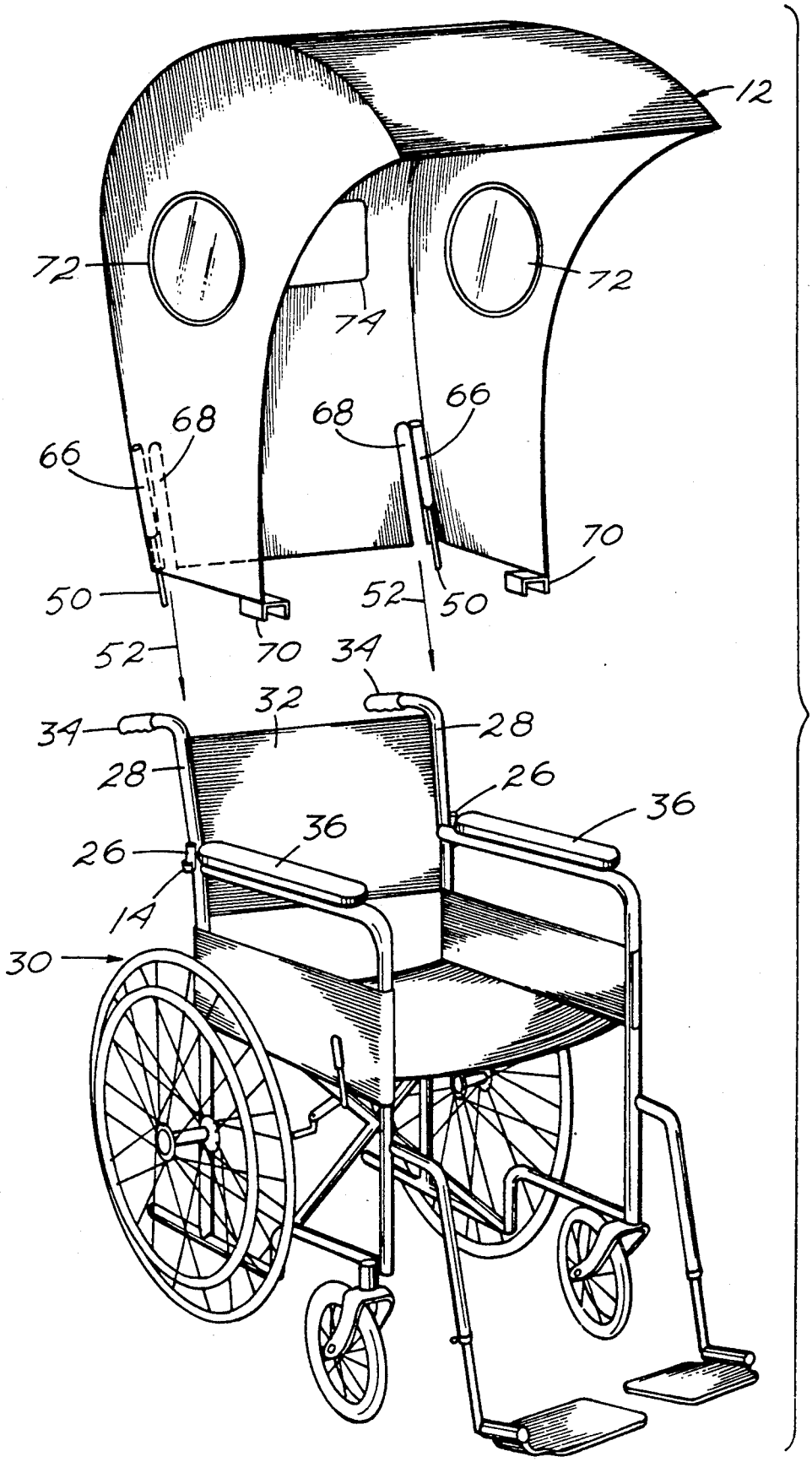
FIG. 7 is a perspective view of a one-piece hard top cover embodiment of the invention positioned for attachment to a wheelchair. The cover support clamp bracket, common to all embodiments, is shown attached to vertical back tubes of the wheelchair and the narrowed insert ends of the short cover attachment tubes are positioned for insertion into the cover frame stability tubes. Special hard cover armrest brackets at the front edges of the cover fit over the wheelchair armrests to secure the front section of the hard cover. A rear view window and side windows are illustrated.
Figure 8:
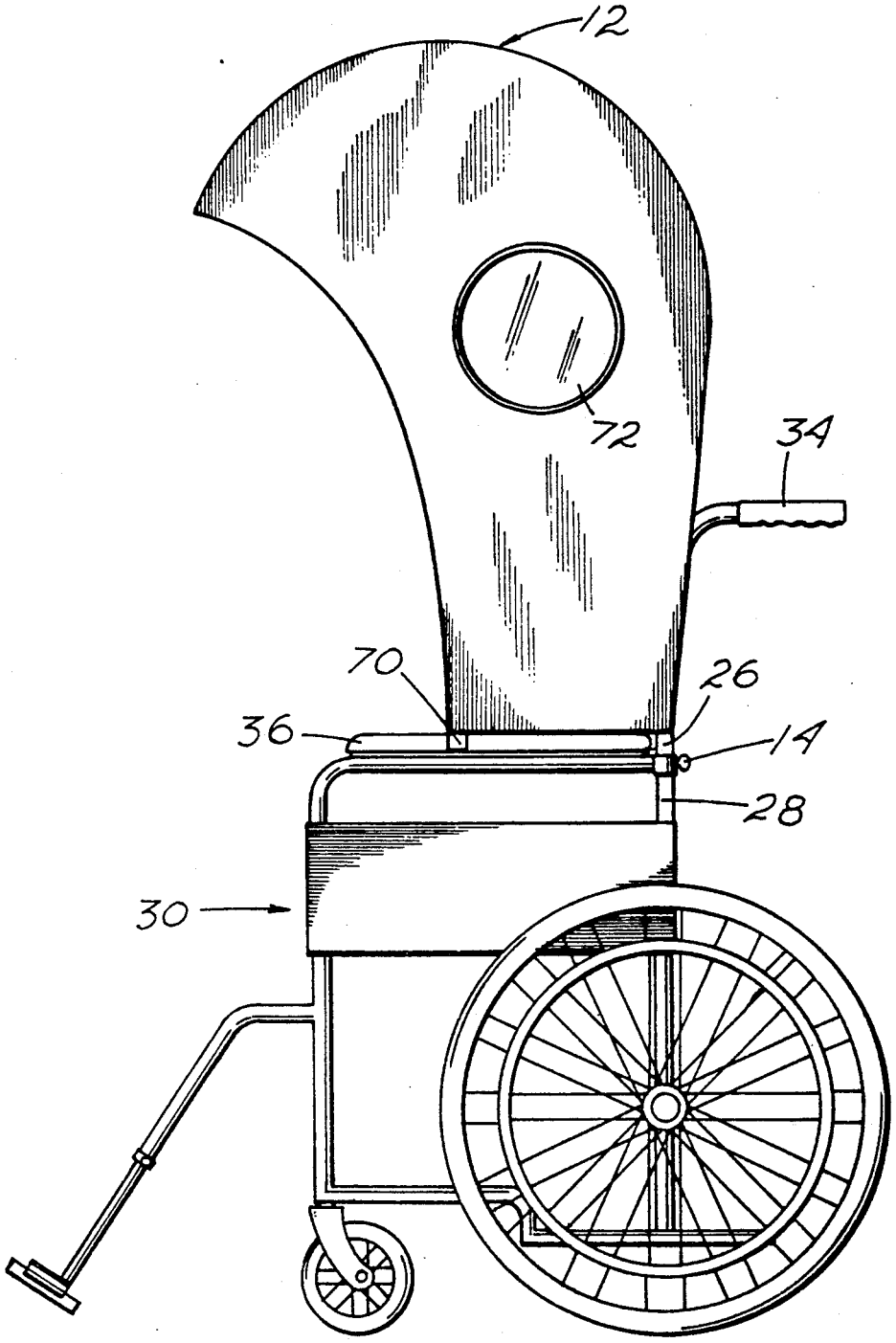
FIG. 8 is a side elevation view of the one-piece cover embodiment attached for use on a wheelchair. The common cover support clamp bracket retains the back of the cover and the hard cover brackets maintain the lower edges aligned and attached to the wheelchair armrests.

A one-piece hard cover embodiment of the invention is illustrated in FIG. 7 and designated hard top 12. Hard top 12 is a single piece cover molded of plastic or formed of any material which is light and sufficiently resilient to maintain a premolded shape. Hard top 12 is useful as a sun shade and for protection from inclement weather. A rear window, hard top back view window 74, allows the wheelchair occupant to look behind or is useful for surveillance of a wheelchair patient by an attendant. Hard top side view windows 72 allow light in and the occupant to look out the sides of the cover without bending over. As shown in FIG. 7, short pieces of tubular frame, hard top frame members 66, are affixed inside to the lower back corners of hard top 12 having narrowed insert frame ends 50 for insertion into cover frame stability tube 26. Hard top frame members 66 align vertically with wheelchair handle insert openings 68 inside the cover but on the outside of openings 68. For cover stability, hard top armrest brackets 70, affixed at the front lower edges of hard top 12, snap over wheelchair armrests 36 when hard top 12 is installed. To install, hard top 12 is lowered onto wheelchair 30 with the arms of wheelchair handles 34 passed through wheelchair handle insert openings 68. Narrowed insert frame ends 50 drop into cover frame stability tube 26 and hard top armrest brackets 70 snap over wheelchair armrests 36. With narrowed insert frame ends secured in cover frame stability tube 26 and hard top armrest brackets snapped down over wheelchair armrests 36, hard top 12 is apply secured to wheelchair 30. In FIG. 8, hard top 12 is shown in a side view attached for use to wheelchair 30. Hard top armrest brackets 70 can be seen snapped over wheelchair armrests 36 securing the front lower edge of hard top 12 to wheelchair 30. Cover support clamp bracket 14 attached to wheelchair vertical post member 28 has cover frame stability tube 26 attached and securing the back of hard top 12 to wheelchair 30. As can be seen from the illustrations, hard top 12 can be easily installed or easily removed for storage when not needed.

Although I have described preferred embodiments of the invention in the specification and illustrated them in the drawings, these descriptions and drawing are for illustrative and descriptive purposes only and are not meant to limited modifications to the invention except as those modifications might be limited according to the intended scope of the appended claims.

What I claim is:

1. In combination, a wheelchair having a dismantlable weather breaker cover removably attached thereto, and a storage case with hinged lid attached to said wheelchair and sized to contain and conveniently carry said weather breaker cover in a dismantled condition;

said weather breaker cover comprising two short tubular members each attached by releasable clamping means to vertical posts of said wheelchair positioned adjacent handles of said wheelchair, one said tubular member and clamping means per each of two said vertical posts of said wheelchair, said weather breaker cover further comprising two vertical frame members each removably inserted into said tubular members, one said vertical frame member per each of said tubular members, said weather breaker cover further comprising at least three generally horizontal frame members of which a first two are removably attached by connective means to upper ends of said vertical frame members, and a third said horizontal frame member being removably attached by connective means transversely to the first two horizontal members, said weather breaker cover further comprising a plurality snap-fittings attached to said vertical frame members and said horizontal frame members, said weather breaker cover further comprising a foldable covering removably attached to said vertical frame members and said horizontal frame members by corresponding snap-fittings attached to said foldable covering and releasably snapped onto the snap-fittings of the vertical and horizontal frame members, said foldable covering shaped and positioned to define a weather protective top over said wheelchair, said foldable covering further shaped and positioned to define a weather protective backing adjacent said handles and a backrest of said wheelchair, said weather protective backing of said foldable covering including at least one transparent window to allow for viewing through the protective backing, said weather breaker cover inclusive of said vertical and horizontal frame members and said foldable covering further being structured to be readily dismantlable into a sufficient number of components of sufficiently small size as so allow storage of said weather breaker cover within said storage case attached to said wheelchair with said tubular members and said clamping means being left attached to said vertical posts of said wheelchair to allow for convenient re-assembly and attachment of said weather breaker cover to said wheelchair.

* * * * *